US010767951B2

(12) United States Patent
Schoppman

(10) Patent No.: US 10,767,951 B2
(45) Date of Patent: Sep. 8, 2020

(54) FIREARM SUPPRESSOR WITH MODULAR DESIGN

(71) Applicant: Silent Legion, LLC, Oak Ridge, NC (US)

(72) Inventor: Edward Donald Schoppman, Oak Ridge, NC (US)

(73) Assignee: Silent Legion, LLC, Clarkesville, GA (US)

( * ) Notice: Subject to any disclaimer, the term of this patent is extended or adjusted under 35 U.S.C. 154(b) by 359 days.

(21) Appl. No.: 15/819,508

(22) Filed: Nov. 21, 2017

(65) Prior Publication Data

US 2018/0347931 A1 Dec. 6, 2018

Related U.S. Application Data

(60) Provisional application No. 62/424,757, filed on Nov. 21, 2016.

(51) Int. Cl.

| | |
|---|---|
| ***F41A 21/30*** | (2006.01) |
| ***F41A 21/24*** | (2006.01) |
| ***F41A 21/36*** | (2006.01) |
| ***F41A 21/32*** | (2006.01) |

(52) U.S. Cl.

CPC ..... *F41A 21/30* (2013.01); *F41A 21/24* (2013.01); *F41A 21/325* (2013.01); *F41A 21/36* (2013.01)

(58) Field of Classification Search

CPC ..... F41A 21/30; F41A 21/36; F41A 21/325; F41A 21/24

USPC ..... 181/223; 89/14.4

See application file for complete search history.

(56) References Cited

U.S. PATENT DOCUMENTS

| | | | | |
|---|---|---|---|---|
| 6,276,251 | B1 | 8/2001 | Downing et al. | |
| 6,374,718 | B1 * | 4/2002 | Rescigno | F41A 21/30 89/14.4 |
| 7,661,349 | B1 * | 2/2010 | Brittingham | F41A 21/30 181/223 |
| 7,856,914 | B2 | 12/2010 | Shults et al. | |
| 8,104,570 | B2 | 1/2012 | Miller et al. | |
| 8,307,946 | B1 | 11/2012 | Johnston | |
| 8,459,406 | B1 * | 6/2013 | Dueck | F41A 21/30 181/223 |
| 8,826,793 | B2 * | 9/2014 | Oliver | F41A 21/30 181/223 |
| 8,881,862 | B1 | 11/2014 | Messer, Jr. et al. | |
| 9,482,484 | B2 * | 11/2016 | Barney | F41A 21/30 |
| 9,677,839 | B1 * | 6/2017 | Phoenix | F41A 21/30 |
| 9,746,267 | B2 * | 8/2017 | Smith | F41A 21/30 |
| 10,107,581 | B2 * | 10/2018 | Garst | F41A 21/30 |

(Continued)

FOREIGN PATENT DOCUMENTS

WO WO-2014135639 A1 9/2014

*Primary Examiner* — Forrest M Phillips

(57) ABSTRACT

A firearm suppressor is adapted to convert from an over-barrel configuration to a muzzle-forward configuration. The firearm suppressor includes a core assembly that has a removable expansion chamber that can be included in the over-barrel configuration and removed in the muzzle-forward configuration. The firearm suppressor can be converted from the over-barrel configuration to the muzzle-forward configuration by removing the core assembly from a first hollow sleeve, removing the expansion chamber and inserting the core assembly into a shorter second sleeve.

19 Claims, 16 Drawing Sheets

(56) References Cited

U.S. PATENT DOCUMENTS

| | | | | |
|---|---|---|---|---|
| 2003/0145718 | A1* | 8/2003 | Hausken | F41A 21/30 89/14.4 |
| 2007/0095198 | A1* | 5/2007 | Dater | F41A 21/325 89/14.2 |
| 2016/0018178 | A1* | 1/2016 | Johansen | F41A 21/30 181/223 |
| 2016/0109205 | A1* | 4/2016 | Coppinger | F41A 21/30 89/14.4 |

* cited by examiner

FIREARM SUPPRESSOR WITH MODULAR DESIGN

CROSS-REFERENCE TO RELATED APPLICATIONS

This application claims the benefit of U.S. Provisional Application No. 62/424,757, filed on Nov. 21, 2016. The entire disclosure of the above application is incorporated herein by reference.

FIELD

The present disclosure relates to a firearm suppressor with a modular design.

BACKGROUND

A firearm suppressor is a device attached to the barrel of a firearm which reduces the amount of noise generated from firing the firearm. Suppressors are typically constructed of a metal cylinder with an internal mechanism to reduce the sound of firing by slowing the escaping propellant gas. Most suppressors are designed to work with a particular firearm type. Therefore, it is desirable for a suppressor that is configured for attachment to different types of firearms.

This section provides background information related to the present disclosure which is not necessarily prior art.

SUMMARY

This section provides a general summary of the disclosure, and is not a comprehensive disclosure of its full scope or all of its features.

In one example in accordance with the present disclosure, a firearm suppressor has a modular design permitting the firearm suppressor to be converted between an over-barrel configuration to a muzzle-forward configuration. The firearm suppressor includes a hollow sleeve with an outer surface extending between an entry end and an exit end of the hollow sleeve and a locator cap connected at the exit end of the hollow sleeve. The locator cap includes a central hole and a first alignment feature. The firearm suppressor further includes a cylindrical body defining a central longitudinal passage and a plurality of vents. The plurality of vents are in fluid communication with the longitudinal passage and are oriented at an angle with respect to a central axis of the central longitudinal passage. The cylindrical body includes a first end that is configured to removably attach to a barrel of a firearm and a second end that is positioned opposite to the first end.

The example firearm suppressor also includes a centering ring connected to the cylindrical body at the second end. The centering ring includes a second alignment feature that is configured to engage the first alignment feature on the locator cap to align the cylindrical body in the sleeve such that the central longitudinal passage is aligned with the central hole of the locator cap. The firearm suppressor includes a plurality of baffles received over the body and spaced apart from one another by a plurality of spacers. The plurality of baffles positioned between the plurality of vents to define a plurality of chambers between the hollow sleeve and the cylindrical body.

The firearm suppressor also includes an expansion chamber removably connected to the first end of the cylindrical body opposite to the centering ring. The expansion chamber extends away from the first end of the cylindrical body such that when the cylindrical body is attached to the barrel of the firearm, the expansion chamber surrounds a portion of the barrel. The firearm suppressor includes an end cap removably connected to the entry end of the sleeve. The end cap contacts the expansion chamber to retain the expansion chamber and the cylindrical body in the hollow sleeve.

In another aspect of the present disclosure, a method for converting a firearm suppressor from the over-barrel configuration to the muzzle-forward configuration is contemplated. One example method includes removing an end cap from a first sleeve of the firearm suppressor and removing a core assembly from the first sleeve. The example method also includes removing the expansion chamber from the core assembly, inserting the core assembly without the expansion chamber into a second sleeve wherein the second sleeve has a length that is shorter than a length of the first sleeve and connecting the end cap to the second sleeve to retain the core assembly without the expansion chamber inside the second sleeve.

In another aspect of the present disclosure, a kit can be provided that permits a user to assemble an example firearm suppressor of the present disclosure and to convert the firearm suppressor between the over-barrel configuration and the muzzle-forward configuration. An example kit includes a locator cap, a first sleeve, a second sleeve (having a length that is shorter than the length of the first sleeve), a body, a centering ring, a series of baffles, a series of spacers, an expansion chamber and an end cap.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
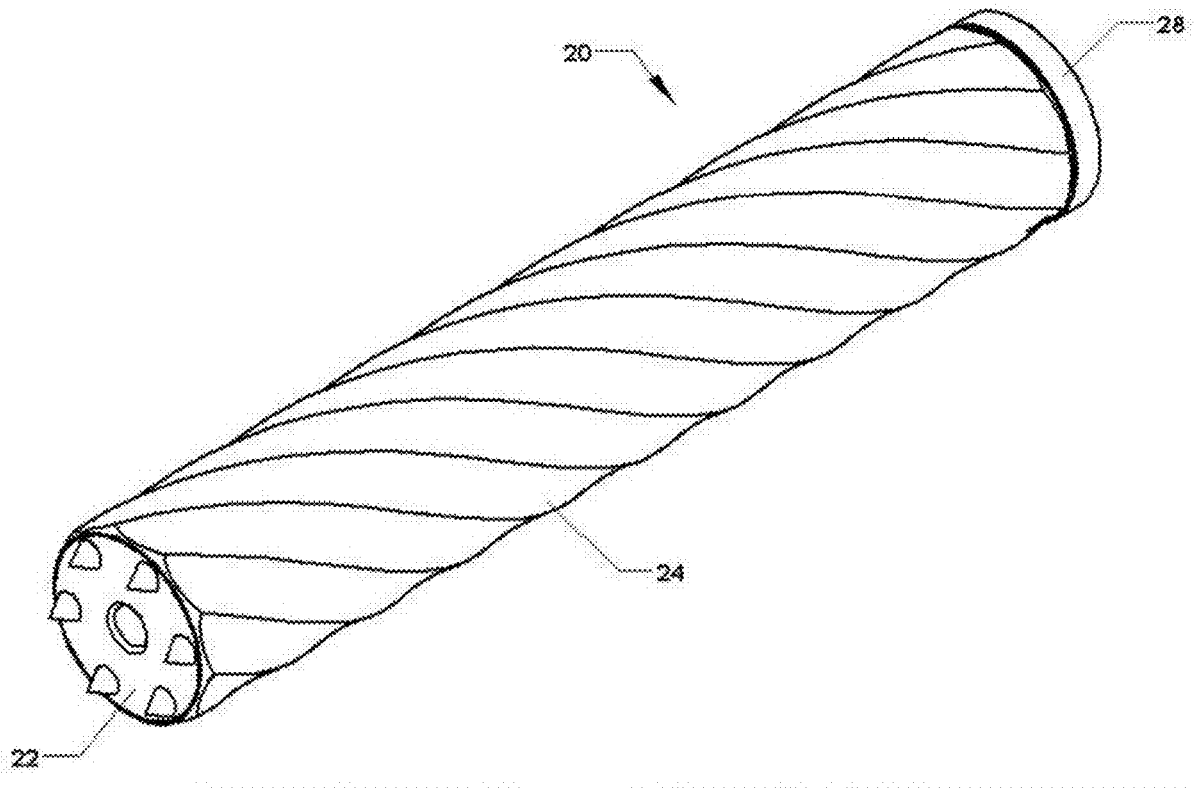
FIG. 1 is a perspective view of an example embodiment of a firearm suppressor having a modular design in accordance with the present disclosure.
Figure 3:
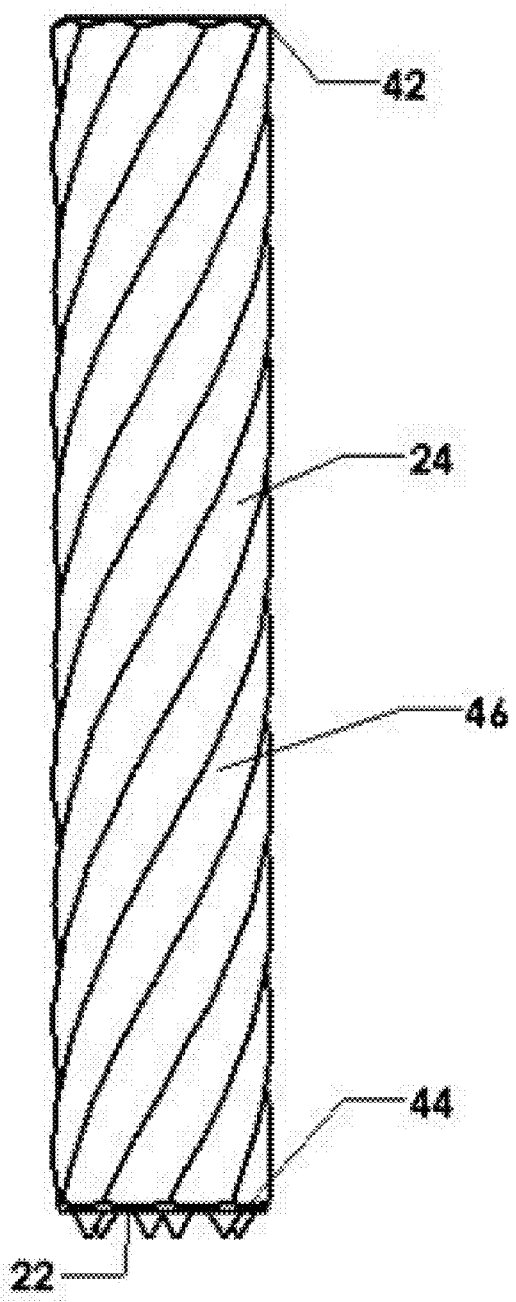
Figure 4:
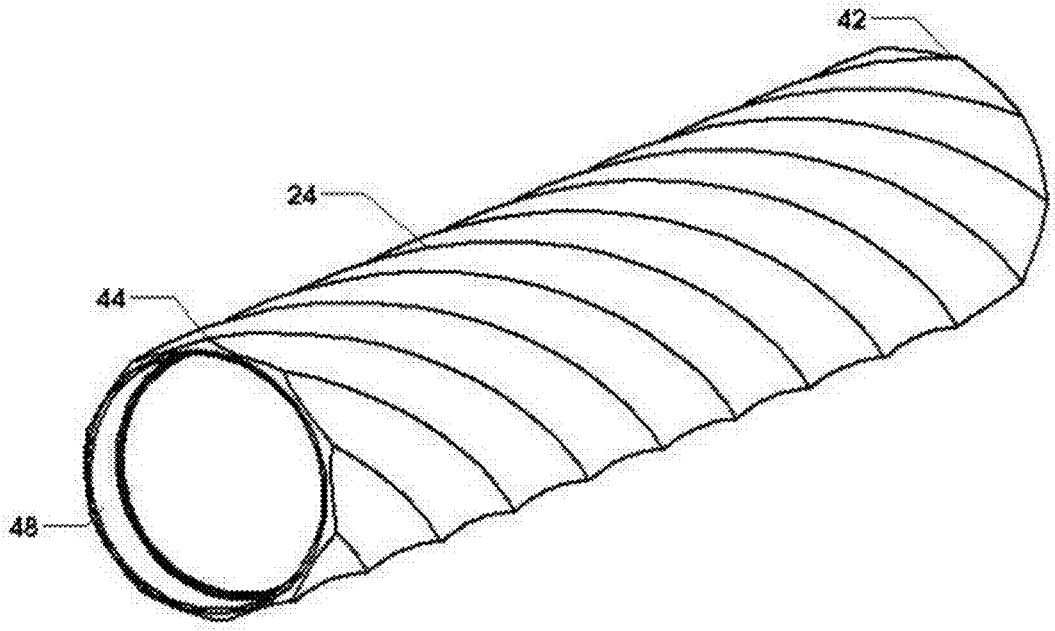
Figure 5:
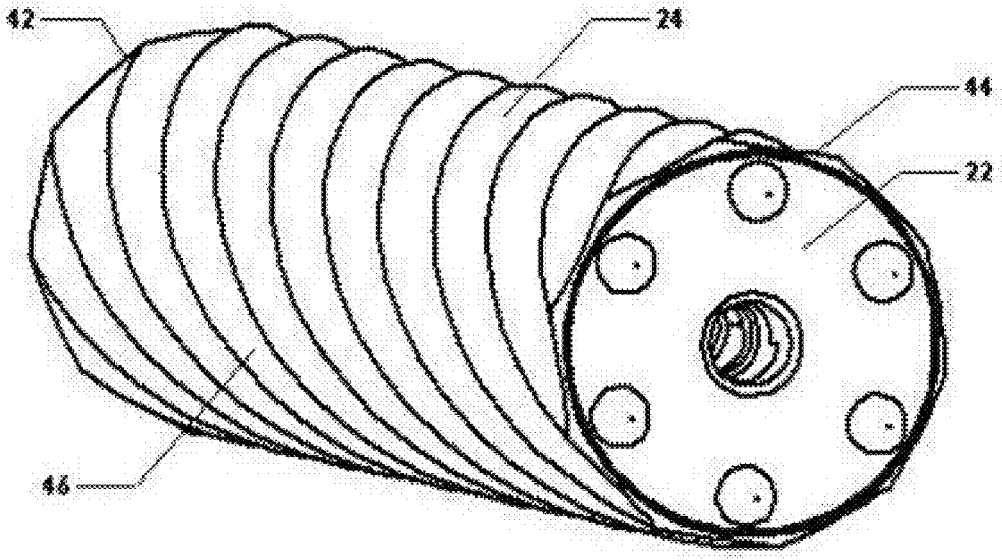
Figure 6:
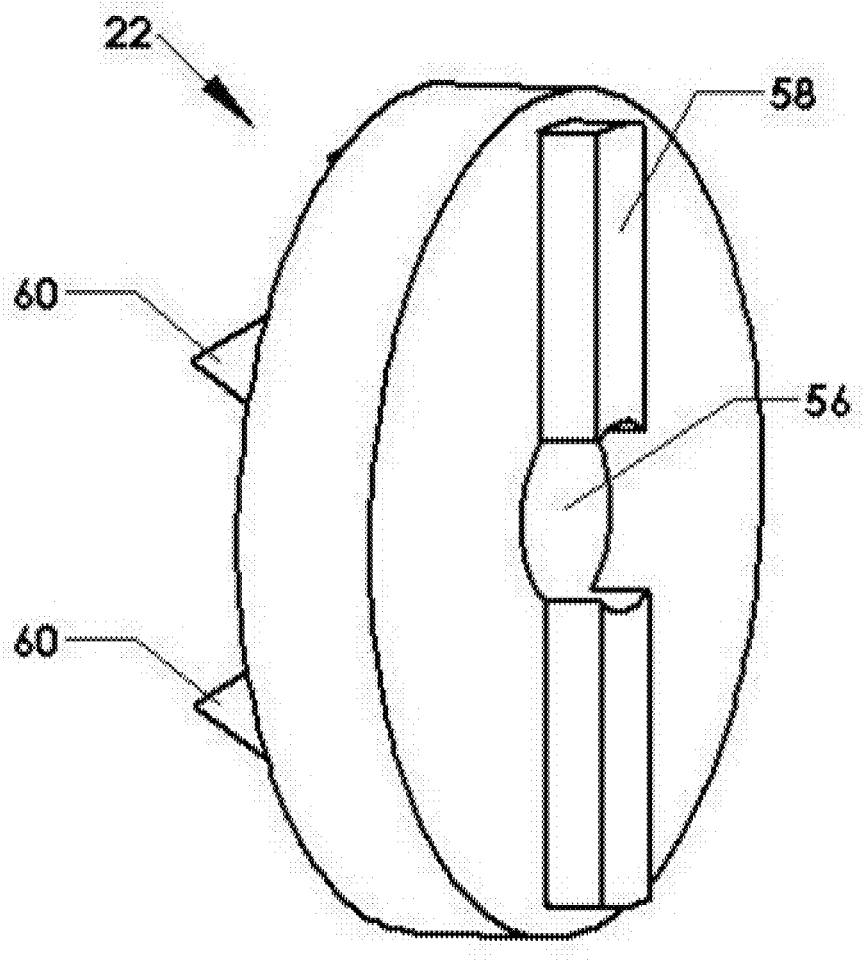
Figure 7:
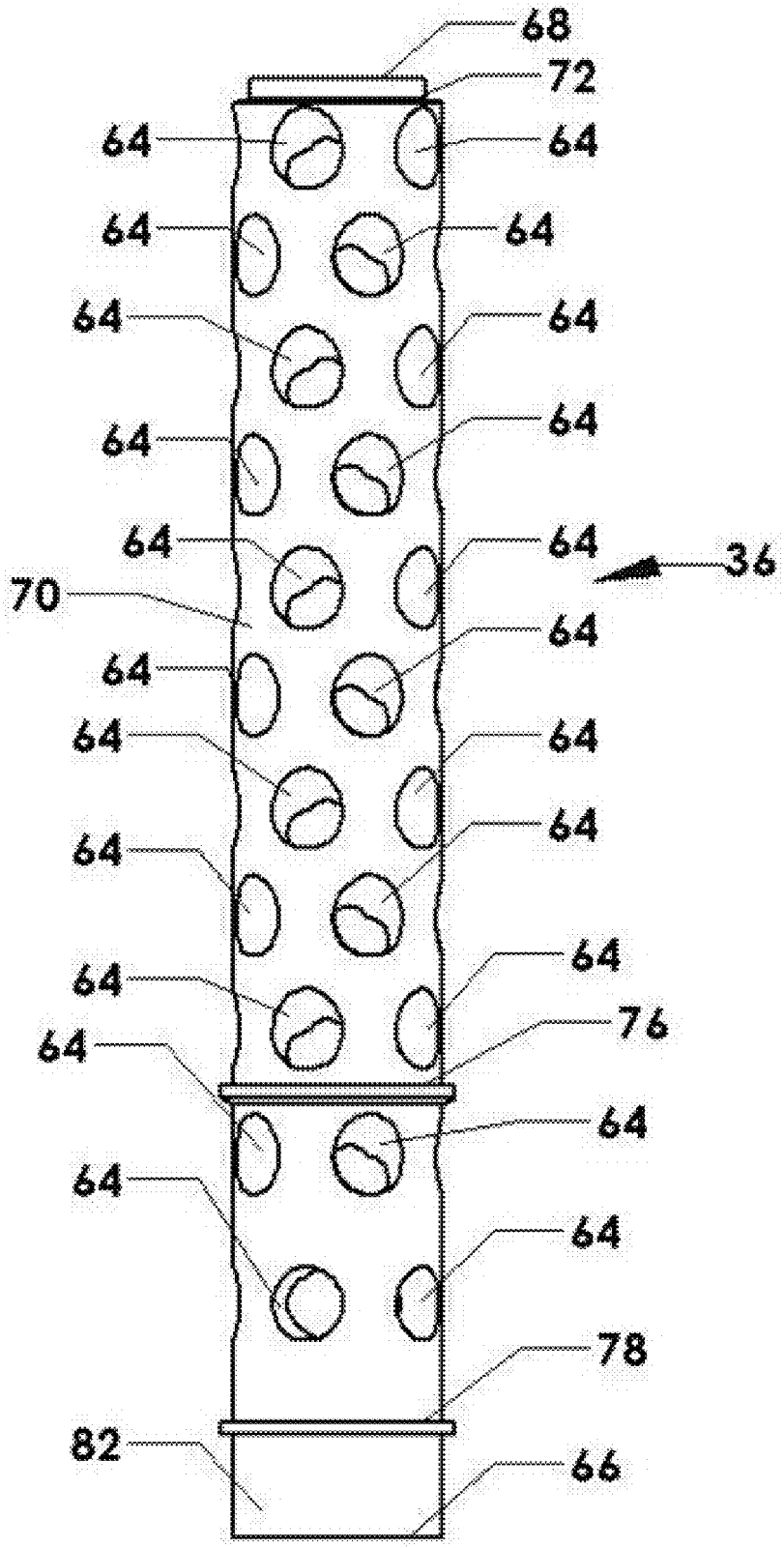
Figure 8:
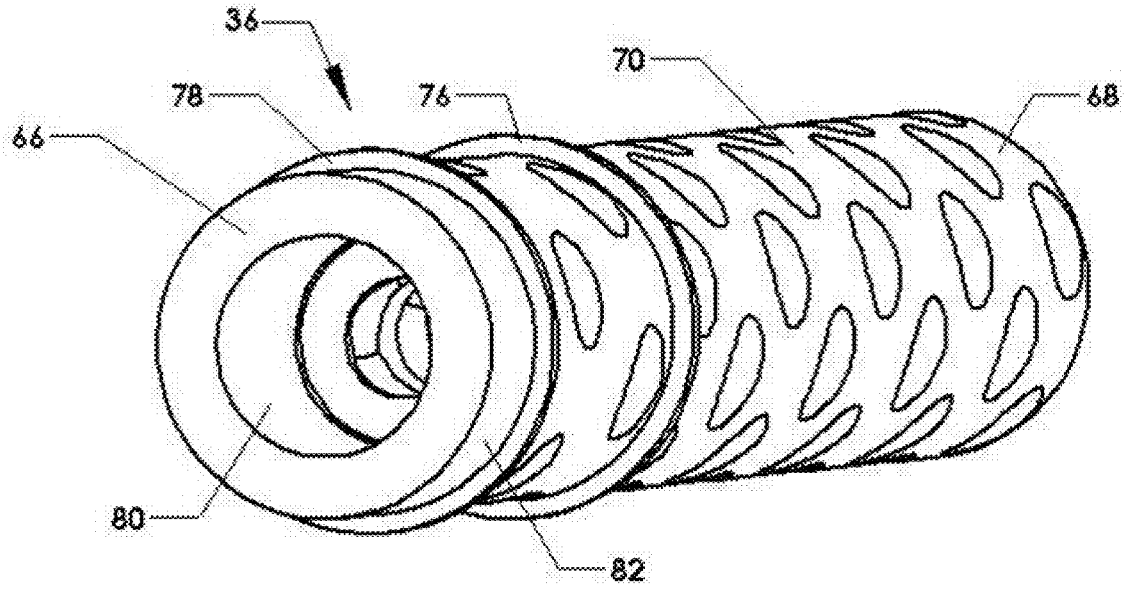
Figure 9:
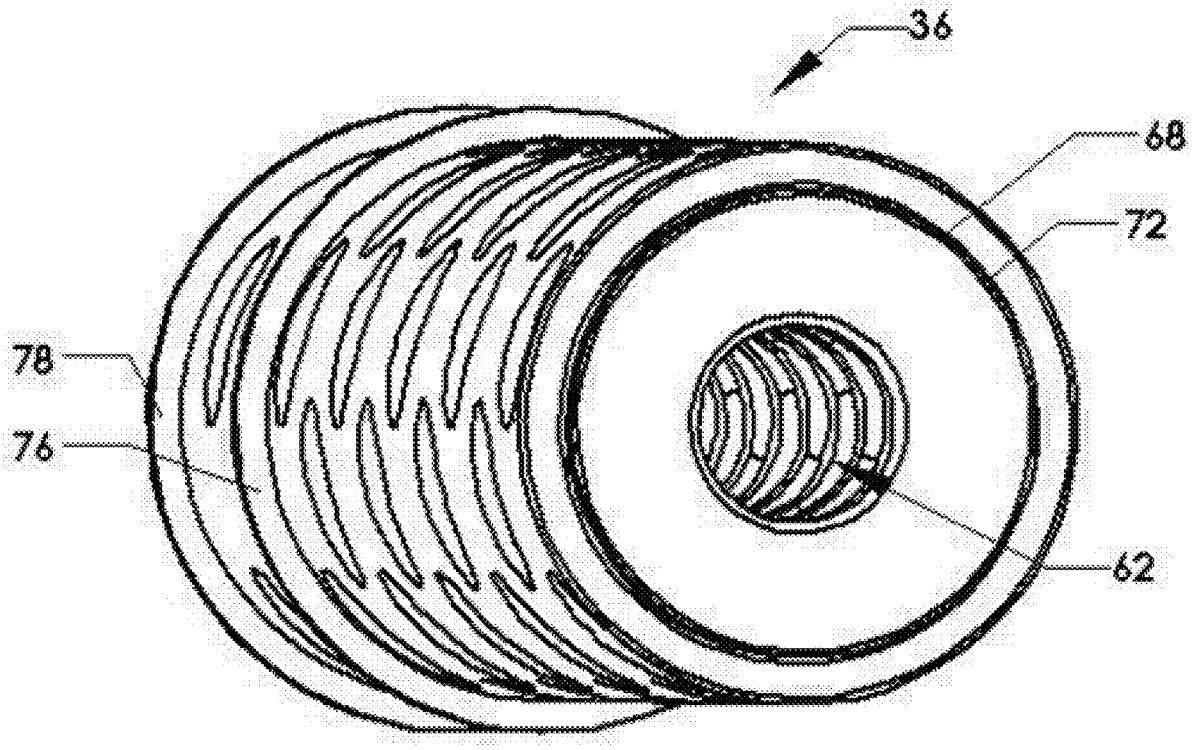
Figure 10:
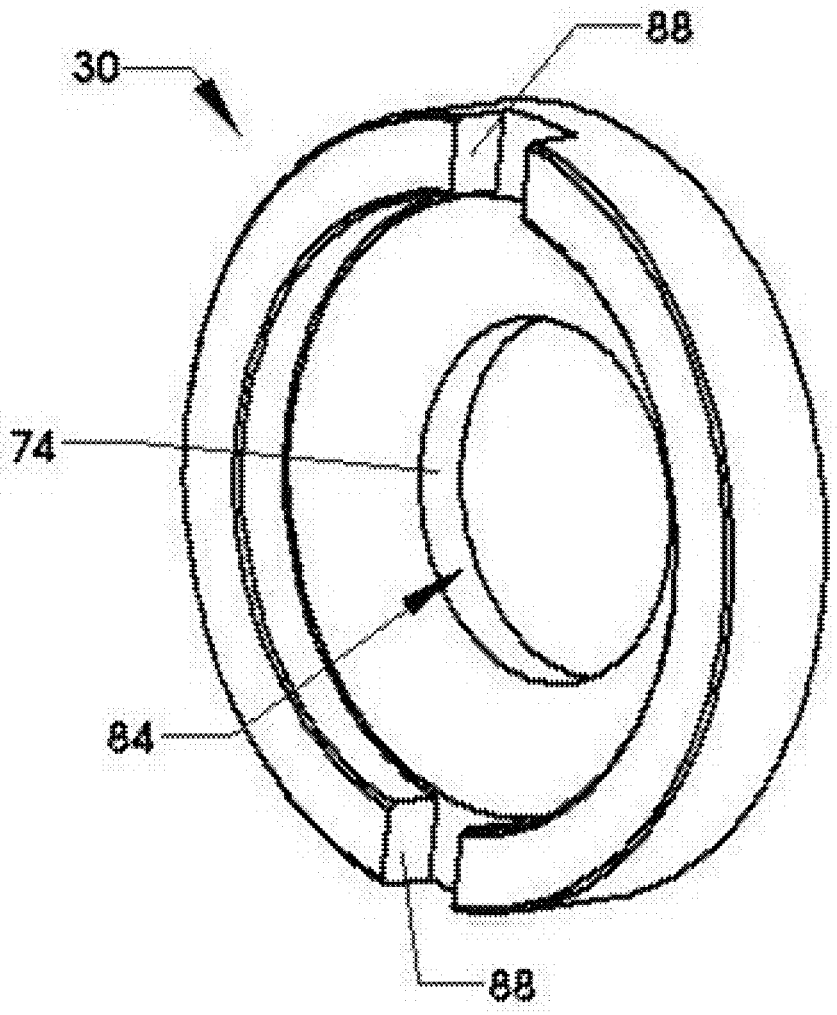
Figure 11C:
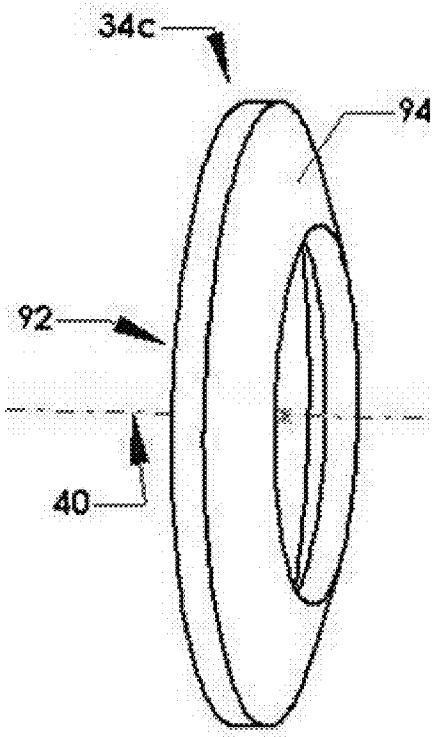
Figure 11B:
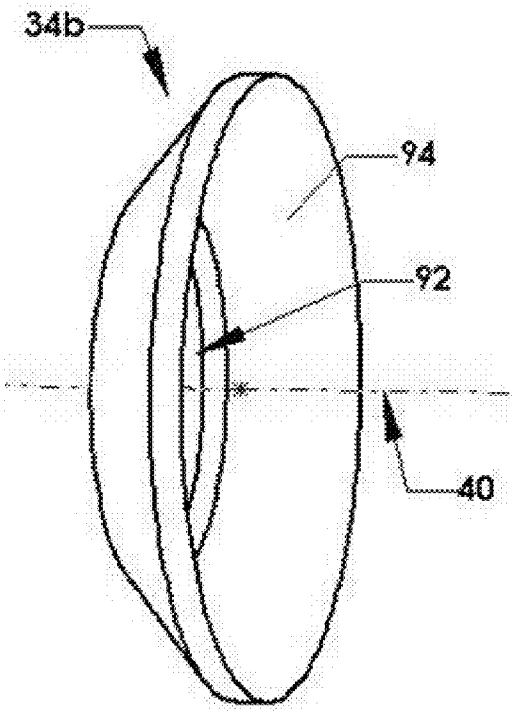
Figure 11A:
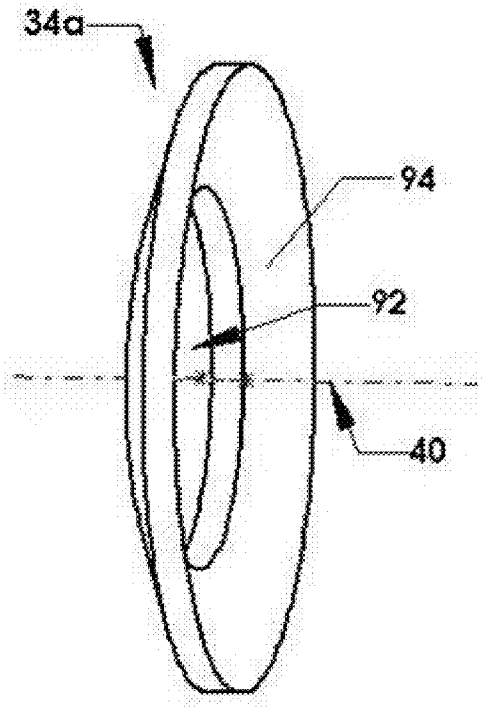
Figure 12:
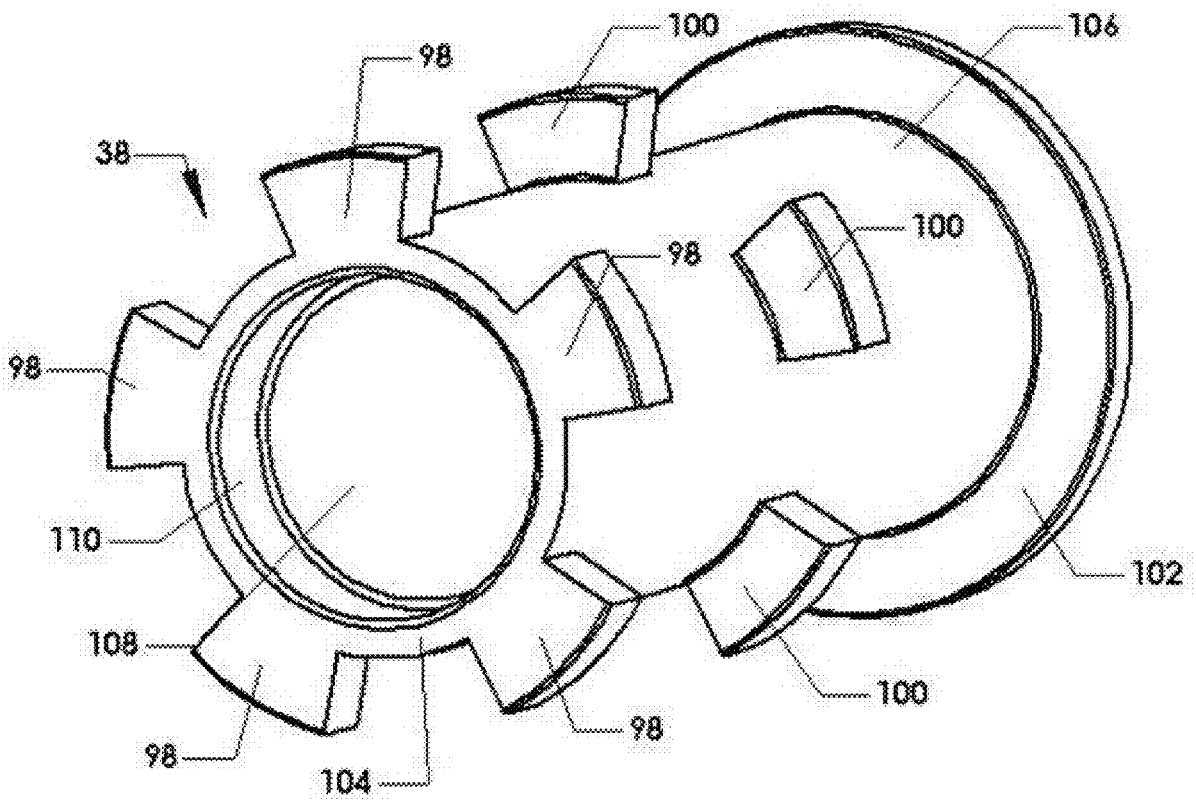
Figure 13:
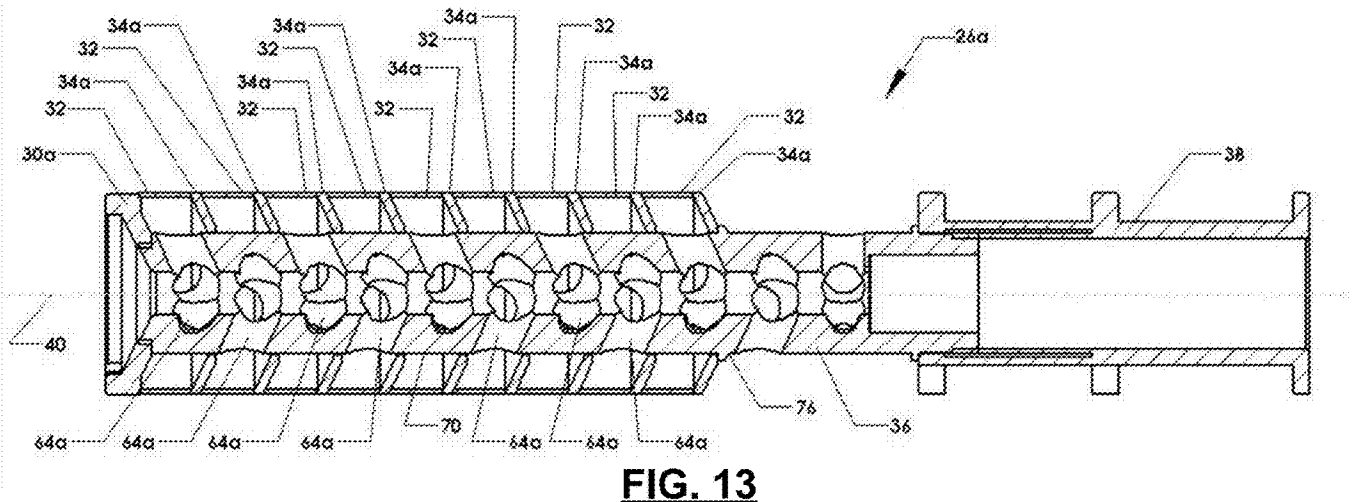
Figure 14:
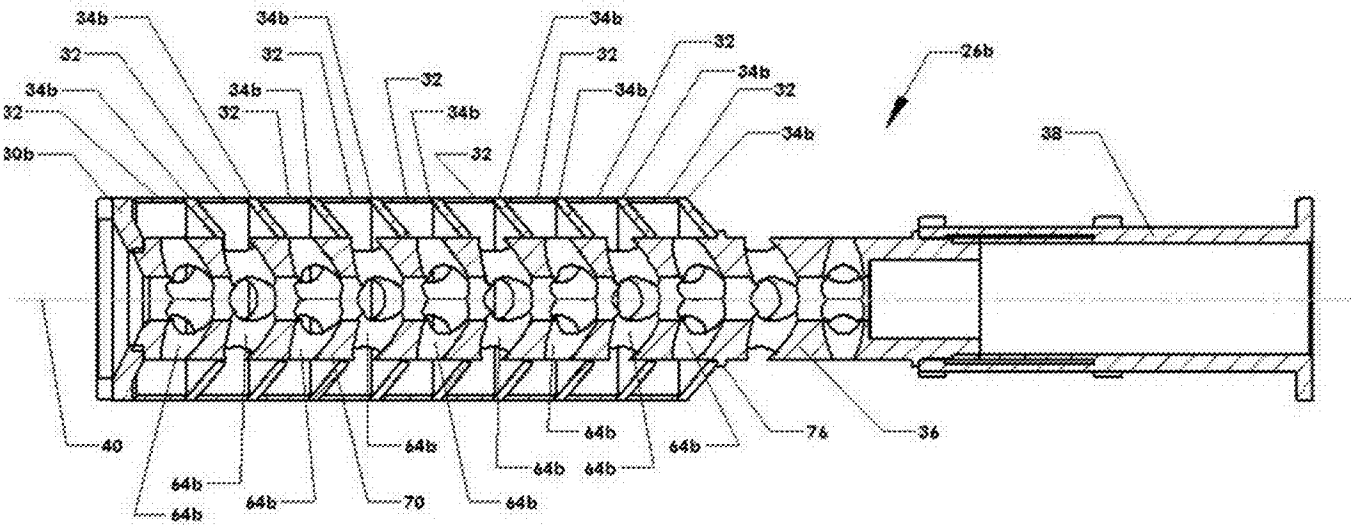
Figure 15:
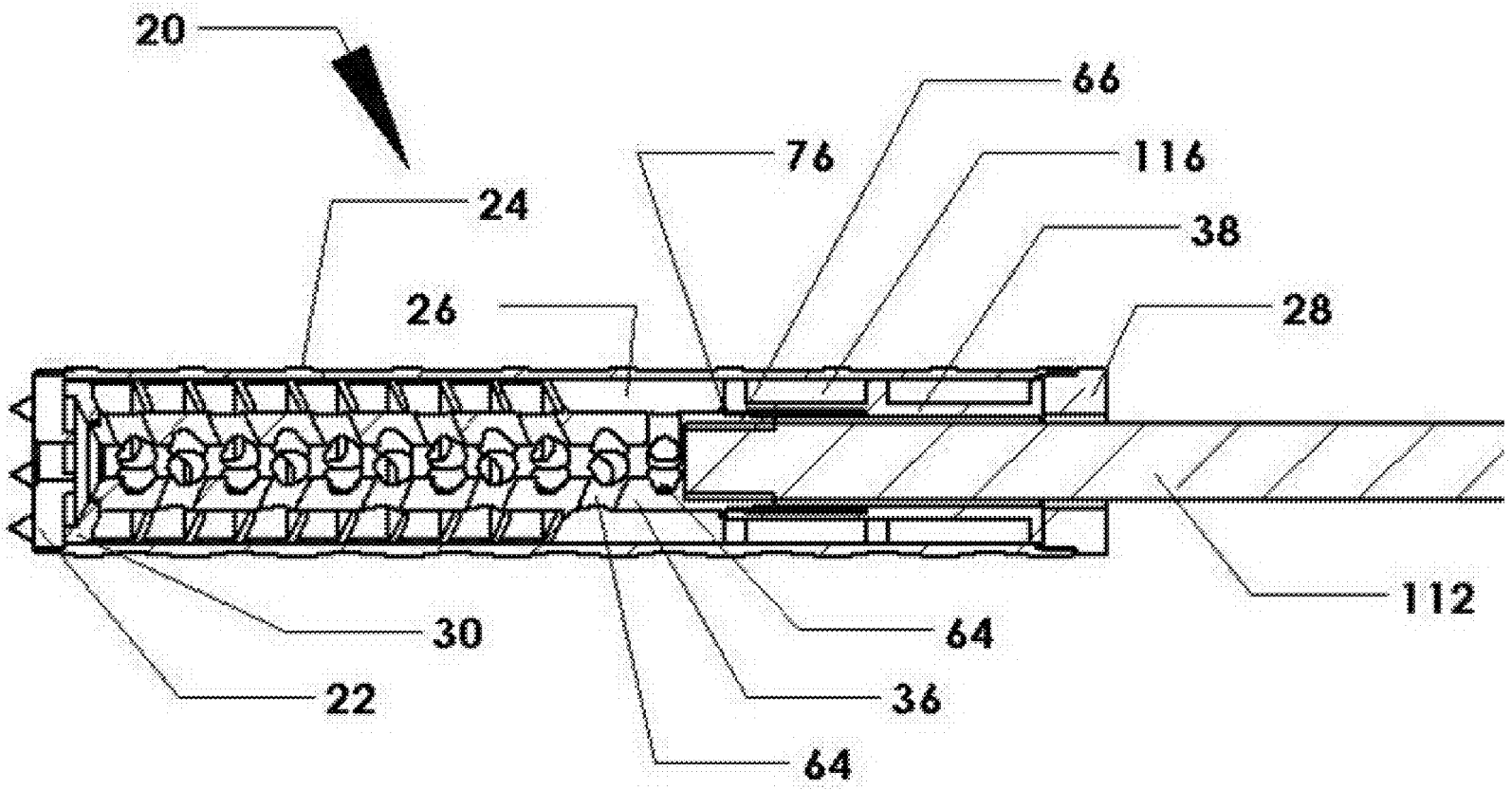
Figure 16:
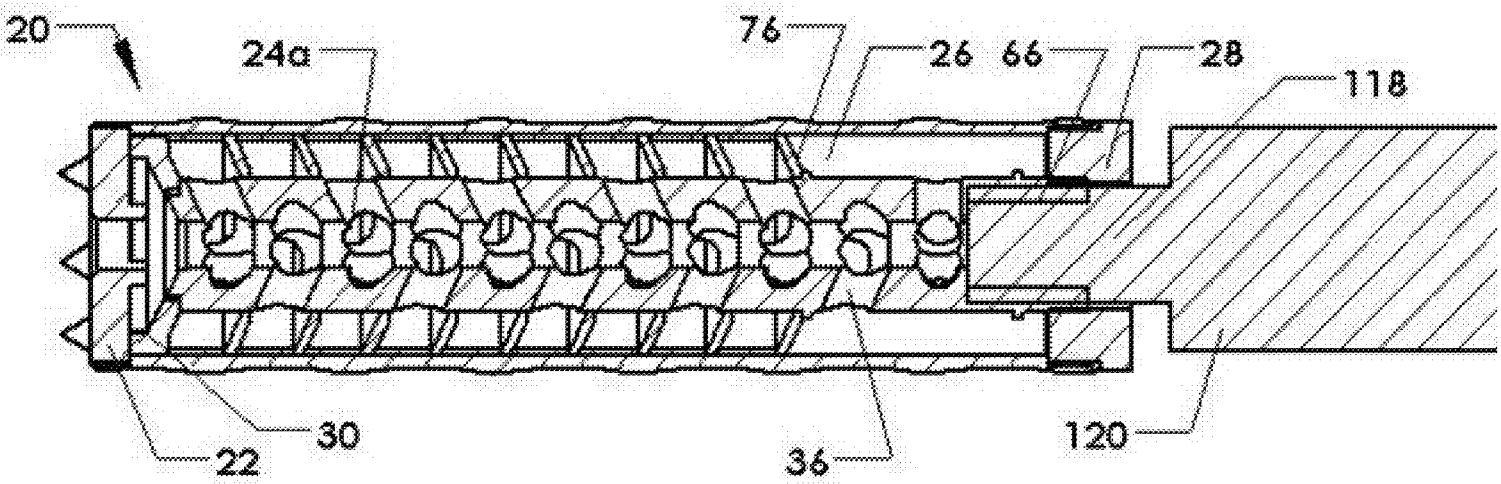
Figure 17A:
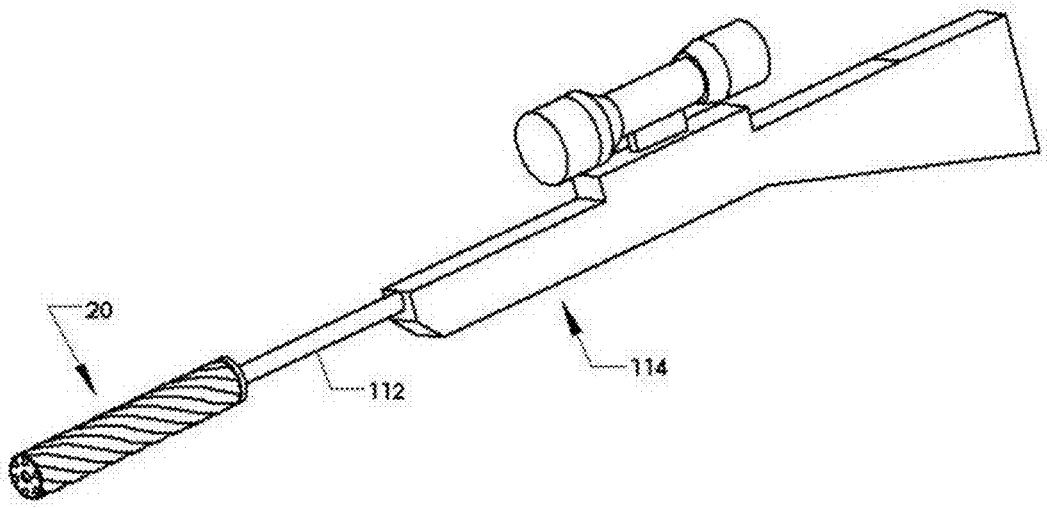
Figure 17B:
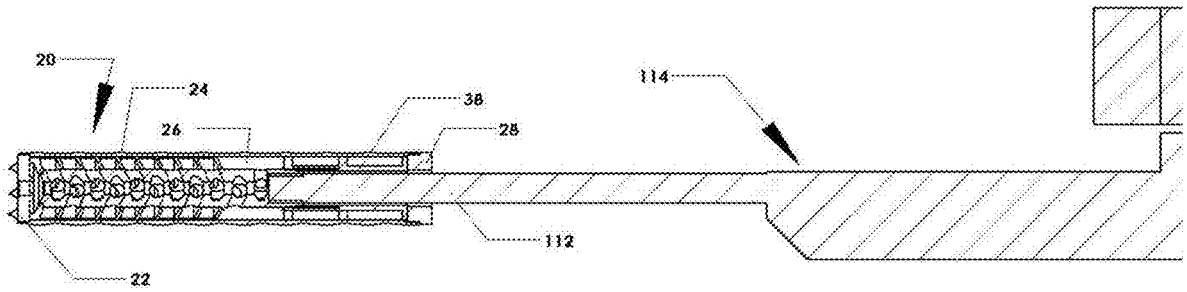
Figure 18A:
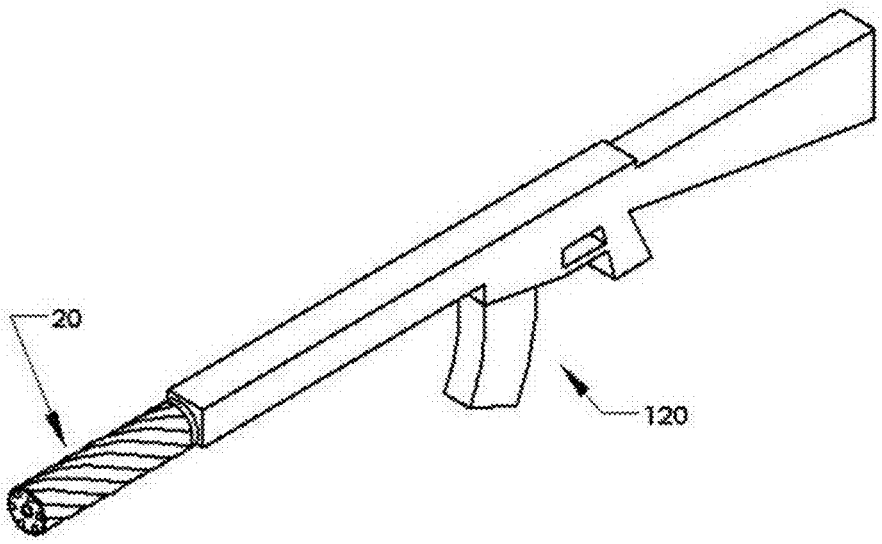
Figure 18B:
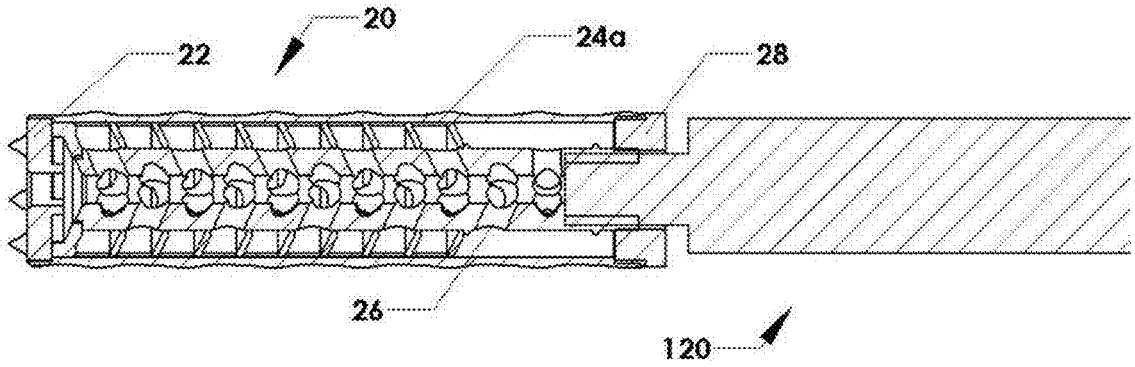
Figure 19:
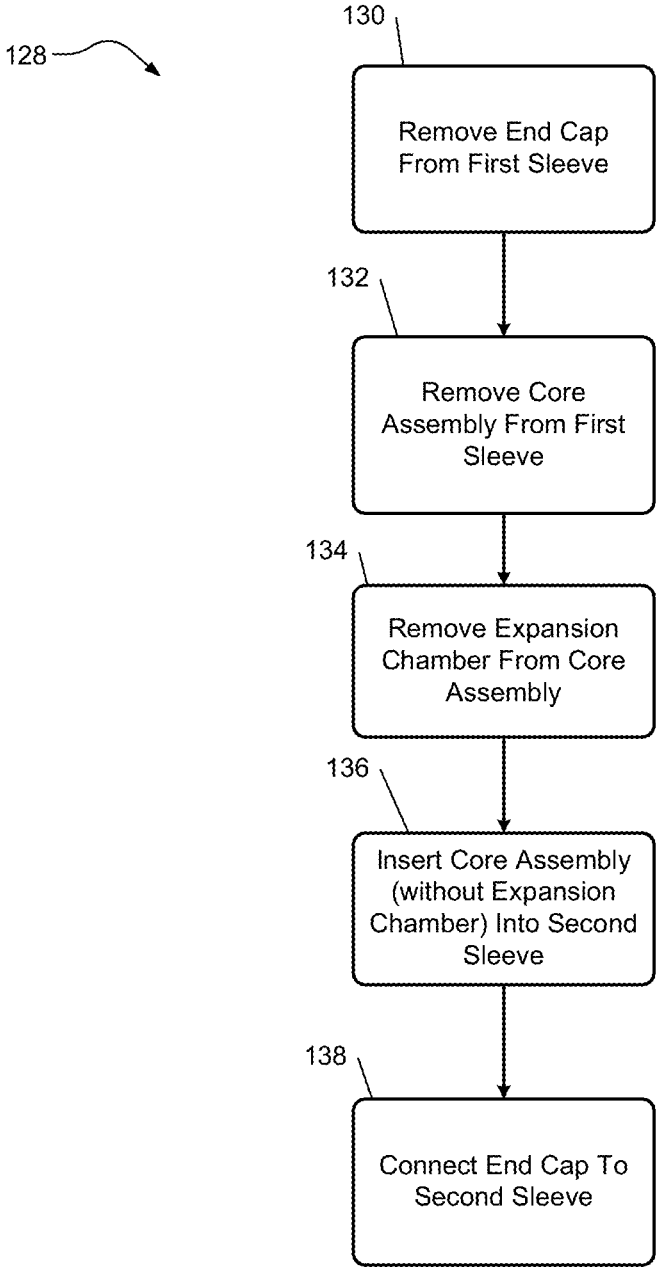

FIG. 3 a top view of an example sleeve of the firearm suppressor of FIG. 1;

FIG. 4 is a view of an exit end of the example sleeve of the firearm suppressor of FIG. 1;

FIG. 5 is a view of the exit end of the example sleeve of the firearm suppressor of FIG. 1 with a locator cap;

FIG. 6 is a view of the locator cap of the firearm suppressor of FIG. 1;

FIG. 7 is an example body of the firearm suppressor of FIG. 1;

FIG. 8 is a view of a muzzle end of the body of the firearm suppressor of FIG. 1;

FIG. 9 is a view of a distal end of the body of the firearm suppressor of FIG. 1;

FIG. 10 is a view of a centering ring of the firearm suppressor of FIG. 1;

FIGS. 11A-11C are side views of example baffles having different angles that can be used in the firearm suppressor of FIG. 1;

FIG. 12 is a view of an example expansion chamber of the firearm suppressor of FIG. 1;

FIG. 13 is a cross-sectional side view of a core assembly of the firearm suppressor of FIG. 1;

FIG. 14 is a cross-sectional side view of another example core assembly suppressor with a different baffle angle from that of core assembly shown in FIG. 13;

FIG. 15 is a cross-sectional side view of the firearm suppressor of FIG. 1 shown in a over-barrel configuration;

FIG. 16 is a cross-sectional side view of the firearm suppressor of FIG. 1 shown in a muzzle-forward configuration;

FIGS. 17A and 17B are a perspective view and a cross-sectional side view, respectively, of the firearm suppressor of FIG. 1 attached to a firearm in the over-barrel configuration;

FIGS. 18A and 18B are a perspective view and a cross-sectional side view, respectively, of the firearm suppressor of FIG. 1 attached to a firearm in the muzzle-forward configuration; and FIG. 19 is a flow-chart showing an example method of converting the firearm suppressor from the over-barrel configuration to the muzzle-forward configuration.

Corresponding reference numerals indicate corresponding parts throughout the several views of the drawings.

DETAILED DESCRIPTION

Example embodiments will now be described more fully with reference to the accompanying drawings.

FIGS. 1-18 illustrate an example embodiment of a modular firearm suppressor. The modular firearm suppressor is designed for superior heat dissipation, sound reduction, and recoil reduction. The modular firearm suppressor is also easy to disassemble, maintain, and repair. In addition to the foregoing advantages, the modular firearm suppressor of the present disclosure enables a user to easily convert the firearm suppressor from an over-barrel configuration with an expansion chamber for additional heat dissipation, sound reduction and/or recoil reduction to a muzzle-forward configuration without the expansion chamber. Since the modular firearm suppressor can be used in the over-barrel configuration and in the muzzle-forward configuration, the modular firearm suppressor can be used on multiple types, calibers and sizes of firearms.

Figure 2:
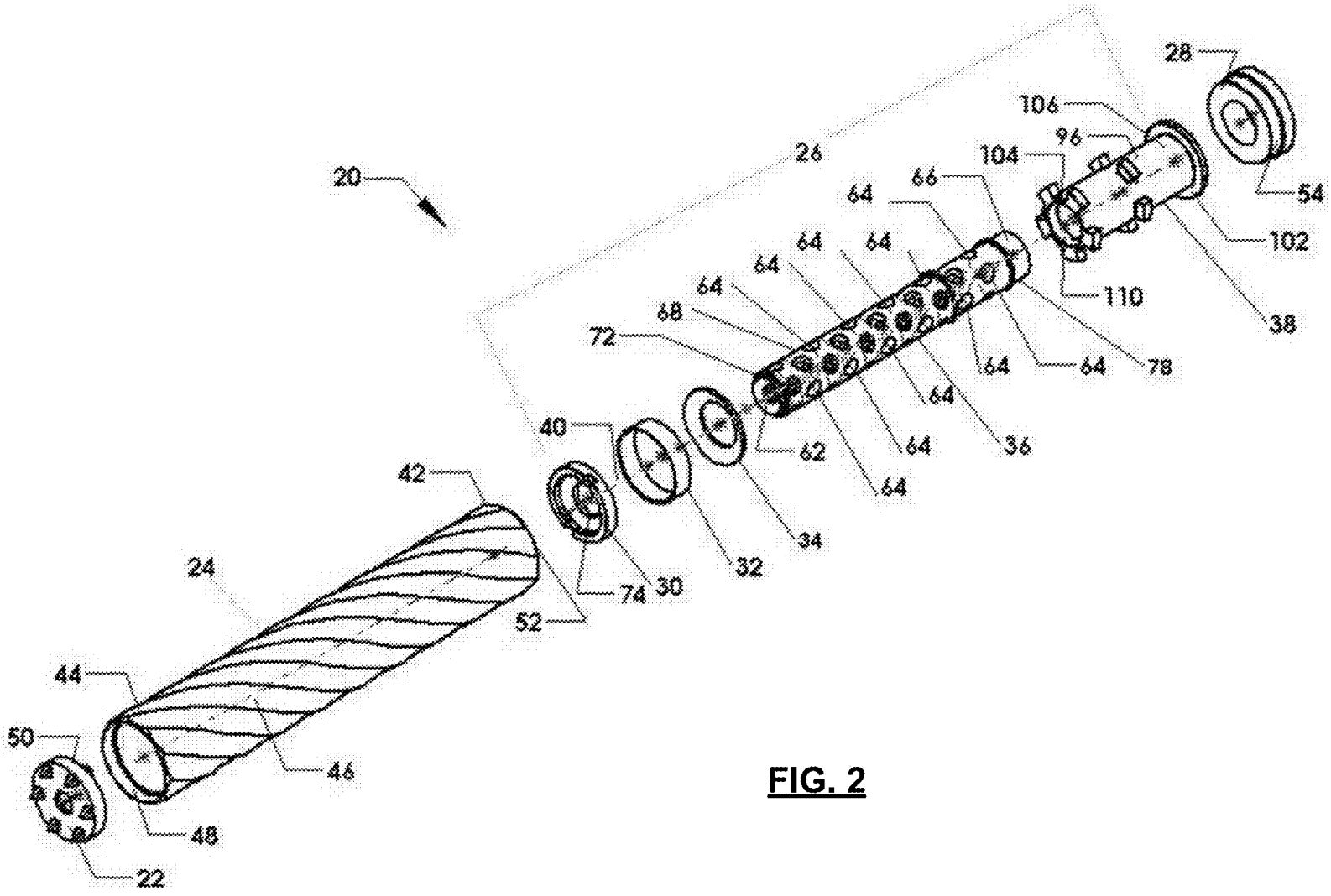
FIG. 2 is an exploded perspective view of the example embodiment of the firearm suppressor of FIG. 1.

Referring now to FIGS. 1 and 2, an example firearm suppressor 20 includes a locator cap 22, a sleeve 24, a core assembly 26 and an end cap 28. The core assembly 26 is a subassembly of the firearm suppressor 20 that is inserted into the sleeve 24 and retained inside the sleeve 24 between the locator cap 22 and the end cap 28. In the example shown, the core assembly 26 includes a centering ring 30, a series of spacers 32, a series of baffles 34, a body 36 and an expansion chamber 38.

The elements of the example firearm suppressor 20 are axially aligned along a center axis 40. When the firearm suppressor 20 is attached to a firearm, as will be explained in more detail below, the firearm suppressor 20 is oriented with one end positioned at or near a muzzle of the firearm and the opposite end positioned distally away from the muzzle of the firearm. In this manner, a projectile that is fired from the firearm can travel through the firearm suppressor 20 and exit the firearm suppressor and travel toward a target. During this action, propellant gas is ejected from the muzzle of the firearm. The firearm suppressor 20 slows and cools the propellant gas that is ejected from the firearm which, in turn, reduces the sound caused by the ejected propellant gas.

Referring now to FIGS. 3-5, the sleeve 24 is a hollow, tubular member that is used to enclose the other components of the firearm suppressor 20. The sleeve 24 includes an entry end 42 and an exit end 44. The sleeve 24, in the example shown, has an external surface 46 that has a helical splined profile. The helical splined surface profile extends along the entire external surface 46. In other examples, the helical splined surface profile can extend along only a portion of the external surface 46. The helical splined surface profile of the sleeve 24 increases the surface area of the external surface 46 over that of a smooth external surface. The increased surface area improves heat dissipation of the sleeve 24 as well as improving the manual gripping surface of the sleeve 24 for manipulation of the firearm suppressor 20. In other examples of the sleeve 24, the external surface 46 can have other surface profiles or features to increase the surface area of the external surface 46 over that of a smooth surface such as projections, multiple facets, radial grooves, radial ribs or other complex profiles.

The sleeve 24 is configured such that the locator cap 22 can be connected at the exit end 44 and the end cap 28 can be connected to the entry end 42. In the example shown, the sleeve 24 includes a threaded portion 48 at the exit end 44 on the inner surface of the sleeve 24. The threaded portion 48 engages a complimentary threaded portion 50 on the outer surface 52 of the locator cap 22. In this manner, the locator cap 22 can be tightened into the exit end 44 of the sleeve 24. The locator cap 22 can also be removed from the sleeve 24 by unscrewing the locator cap 22. In other examples, the locator cap 22 can be otherwise removably attached to the sleeve 24 by using other configurations of the locator cap 22 and/or the sleeve 24. For example, the locator cap 22 can have internal threads and the sleeve 24 can have complimentary threads on the external surface 46 at the exit end 44. In still other examples, the locator cap 22 can be fixedly secured to the exit end 44 of the sleeve 24. In such examples, the locator cap can be welded or otherwise secured to the sleeve 24.

At the entry end 42 of the sleeve 24, the sleeve 24 includes, in the example shown, a threaded portion 52. The threaded portion 52 is positioned on the inside surface of the sleeve 24 and is configured to engage a complimentary threaded portion 54 positioned on an external surface of the end cap 28. In this manner, the end cap 28 can be tightened to (or loosened from) the entry end 42 of the sleeve 24. In other examples, the end cap 28 can be otherwise removably attached to the sleeve 24 by using other configurations of the end cap 28 and/or the sleeve 24. For example, the end cap 28 can have internal threads and the sleeve 24 can have complimentary threads on the external surface 46 at the entry end 42. In still other examples, the end cap 28 can be fixedly secured to the entry end 42 of the sleeve 24. In such examples, the end cap 28 can be welded or otherwise secured to the sleeve 24.

As shown in FIG. 6, the locator cap 22 is a disc-shaped element that is used to close the exit end 44 of the sleeve 24. The locator cap 22 includes a center hole 56 that extends through the locator cap 22 and is positioned at the center of the locator cap 22. When the firearm suppressor 20 is attached to a firearm, the center hole is aligned with the barrel of the firearm and permits a projectile to exit the firearm suppressor 20. The locator cap 22 also includes one or more projections 60 that project outward and away from the exit end of the sleeve 24. The projections 60, in this example, are conical pointed projections. The projections can have other shapes and configurations and different quantities and/or arrangements of the projections 60 can also be used. The projections 60 provide a stand-off for the firearm suppressor 20 and can maintain a gap between the exit end of the firearm suppressor 20 and an external surface.

The locator cap 22, in this example, also includes a sleeve alignment feature 58. The sleeve alignment feature 58 interacts with a complimentary alignment feature (e.g., core alignment feature 88, as will be described below) to align and/or center the core assembly 26 inside the sleeve 24 when the core assembly 26 is inserted into the sleeve 24. In this example, the sleeve alignment feature 58 is a raised bar that spans across a side of the locator cap 22 that is positioned inside the sleeve 24 when the locator cap 22 is connected to the sleeve 24. In this manner, the sleeve alignment feature 58 projects axially into the sleeve 24. In other examples, the sleeve alignment feature 58 can have other shapes and configurations. For example, the sleeve alignment feature 58 can be a pin, depression, slot, groove, rib or other shape.

As shown in FIG. 2, the core assembly 26 is inserted into the sleeve 24 in a manner so that the core assembly 26 abuts the locator cap 22 at or near the exit end 44 of the sleeve 24. The body 36 is the central member of the core assembly 26. The centering ring 30, the spacers 32, the baffles 34 and the expansion chamber 38 are connected to the body 36. As such, the core assembly 26 can be easily removed from the sleeve 24 by sliding the core assembly in an axial direction along the center axis 40.

The body 36 is an elongated cylindrical member that includes a longitudinal passage 62 and a series of vents 64. The longitudinal passage 62 is a cylindrical passageway that extends through the body 36 from a muzzle end 66 to an distal end 68 of the body 36. The longitudinal passage is aligned with the center axis of the firearm suppressor 20 and is sized so that the projectile that is fired from the barrel of the firearm can travel through the longitudinal passage 62.

The vents 64 are positioned radially around the longitudinal passage 62 along the body 36. The vents 64 are circular openings that extend from an outer surface 70 of the body 36 to the longitudinal passage 62 to fluidly connect the vents to the longitudinal passage 62. As such, the propellant gas that is ejected from the firearm can travel from the barrel of the firearm into the longitudinal passage and through the vents 64.

The vents 64, in the example shown, are positioned in staggered radial rows along the outer surface 70 of the body 36. The vents 64 are positioned at an oblique angle with respect to the center axis 40. The vents 64, in this example, are positioned such that the vents 64 are angled toward the distal end 68 of the body 36. The vents 64 are angled at a 45 degree angle relative to the center axis in this example. In other examples, the vents can be angled toward the muzzle end 66 of the body 36 and can be angled at other angles but are preferably angled with an angle of 45 degrees to 65 degrees relative to the center axis 40.

The body 36, in the example shown in FIG. 7, also includes a tapered portion 72 positioned at the distal end 68. The tapered portion 72 has a smaller outer diameter than the outer surface 70. The tapered portion 72 is configured to receive the centering ring 30. In this example, the tapered portion 72 includes threads located on the external surface. The centering ring 30 includes a threaded portion 74 on an internal diameter that mates with and attaches the centering ring 30 to the distal end 68 of the body 36.

The body 36, in the example shown, also includes a first shoulder 76 and a second shoulder 78. The first shoulder 76 is a raised circumferential rib that projects radially outward from the outer surface 70. The first shoulder 76 has an outer diameter that is greater than the outer diameter of the outer surface 70. The first shoulder 76 is suitably positioned from the distal end 68 of the body 36 so that the baffles 34 and the spacers 32 that are installed over the body 36 are disposed relative to the vents 64 in a manner to create evenly distributed chambers, as will be further described. In other examples, the first shoulder 76 can have other shapes or profiles. For example, the first shoulder 76 can be configured as one or more discrete projections that project away from the outer surface 70 of the body 36.

The second shoulder 78 is similarly configured as that of the first shoulder 76. The second shoulder 78 is a raised circumferential rib that projects radially outward from the outer surface 70. The second shoulder 78 has an outer diameter that is greater than the outer diameter of the outer surface 70. The second shoulder is suitably spaced at an axial distance away from the muzzle end 66 of the body 36 so that the expansion chamber 38 and/or the end cap 28 can abut the second shoulder 78 to retain the body 36 in position inside the sleeve 24. In other examples, the second shoulder 78 can have other shapes or profiles. For example, the second shoulder 78 can be configured as one or more discrete projections that project away from the outer surface 70 of the body 36.

As shown in FIGS. 7 and 8, the body 36 includes a connector portion 80 and an attachment surface 82 at or near the muzzle end 66. The connector portion 80 is a rounded inset feature at the muzzle end 66 of the body that is configured to receive and attach to the barrel of the firearm. In the example shown, the connector portion 80 is threaded on the inner surface of the connector portion 80. The threads mate with a threaded region on the exterior surface of the barrel of the firearm. In this manner, the body 36 can be secured to the barrel of the firearm by threading the body 36 over the barrel of the firearm at the connector portion 80. The connector portion 80 is centered in the body 36 such that the longitudinal passage 62 is aligned with the barrel of the firearm to permit a projectile to exit the barrel and enter the longitudinal passage 62.

The attachment surface 82 is positioned on an external surface of the body 36 at the muzzle end 66. The attachment surface 82 is configured to attach to the expansion chamber 38. In the example shown, the body 36 is threaded at the attachment surface 82. The expansion chamber 38 has a complimentary threaded surface on an inner surface thereof such that the expansion chamber 38 can be secured (or removed) from the body 36. As explained above, the second shoulder 78 is positioned, in this example, such that the expansion chamber abuts the second shoulder 78 when it is threaded over the attachment surface 82.

The core assembly 26 includes the centering ring 30. As shown in the example of FIG. 10, the centering ring 30 is an annular component with an outer diameter that is smaller than the inner diameter of the sleeve 24. The outer diameter of the centering ring 30 is only slightly less than the inner diameter of the sleeve 24 so that when the centering ring 30 is fitted over the distal end 68 of the body 36, the centering ring 30 centers the core assembly 26 inside the sleeve 24. The centering ring 30 includes a center bore 84 and the threaded portion 74 positioned at the center of the centering ring 30 that is sized to be received over (and threaded onto) the tapered portion 72 of the body 36. In this manner, the centering ring 30 can be secured to and removed from the body 36.

The centering ring 30 also includes a core alignment feature 88. The core alignment feature 88 engages the sleeve alignment feature 58 on the locator cap 22. The core alignment feature 88 orients the core assembly 26 inside the sleeve 24 in a repeatable manner so that the firearm behaves in a similar manner when the firearm suppressor 20 is disassembled and/or reassembled for cleaning or re-configuration. In the example shown, the core alignment feature 88 is a slot that spans across the centering ring 30 and through the rim 90. The sleeve alignment feature 58 (or raised bar in the example shown in FIG. 6) on the locator cap 22 fits inside the core alignment feature 88 in this example to rotationally orient the core assembly 26 inside the sleeve 24. The core alignment feature 88 can have other shapes or other configurations so long as it is adapted to engage the sleeve alignment feature 58 to orient the core assembly 26 in the sleeve 24. In other examples, the core alignment feature 88 can be a pin, depression, slot, groove, rib or other shape.

As shown in FIGS. 2 and 11, the baffles 34 are annular shaped elements that are received over the outer surface 70 of the body 36. As such, the baffles 34 include center apertures 92 and angled walls 94. The center apertures 92 have diameters slightly larger than the outer diameter of the body 36. The angled walls 94 project radially away from the center apertures 92 an oblique angle relative to the center axis 40. The angled walls 94 are angled at an angle coordinated with the angle of the vents 64. In one example, both the angled walls 94 and the vents 64 are oriented to be angled at 45 degrees from the center axis 40. In other examples, the angled walls 94 and the vents 64 have any suitable angle between 45 degrees and 65 degrees but are coordinated to have the same oblique angle. As shown in FIGS. 11A-C, the baffles 34*a*, 34*b*, 34*c* are similar to one another but have different oblique angles relative to the center axis 40. Each of the baffles 34*a*, 34*b* and 34*c* can be used with a different body 36 that includes vents 64 that are oriented with the same oblique angle as the baffle 34*a*, 34*b* or 34*c*.

As shown in FIGS. 2 and 12 and as previously described, the core assembly 26 includes the expansion chamber 38. The expansion chamber 38 is connected to the muzzle end 66 of the body 36. The expansion chamber 38 extends away from the muzzle end 66 and, as will be further described below, extends the firearm suppressor 20 in a manner such that the expansion chamber 38 surrounds the barrel of the firearm when the firearm suppressor 20 is attached to the firearm in an over-barrel configuration. The expansion chamber 38 includes a cylindrical shell 96, a first series of projections 98 and a second series of projections 100 and a base 102. The cylindrical shell 96 has an outer diameter that is less than the inner diameter of the sleeve 24. When assembled to the sleeve 24, the outer surface of the cylindrical shell 96 is radially spaced apart from the sleeve 24.

The projections 98, in the example shown, are wedge-shaped projections that project radially away from the cylindrical shell 96. The first projections 98 are positioned at or near a first end 104 of the expansion chamber 38. The projections 98 project outward and together have an outer radial dimension that fits inside the sleeve 24. The projections 98 are spaced apart from one another around the circumference of the cylindrical shell 96 and assist in centering the expansion chamber 38 inside the sleeve 24. As such, the outer radial dimension is sized relative to the inner diameter of the sleeve 24 so that the expansion chamber 38 fits inside the sleeve 24. In the example shown, the expansion chamber 38 includes five projections 98 evenly spaced around the cylindrical shell 96. In other examples, the expansion chamber 38 can include more or less than five projections 98. In still other examples, the projections 98 can include a single rib or annular wall with openings spaced around the cylindrical shell 96 or the projections 98 can have other shapes or profiles.

The projections 100 are similar to the projections 98 previously described. The projections 100 are positioned at an intermediate location on the cylindrical shell 96 between the first end 104 and a second end 106. The projections 100, in this example, are wedge-shaped projections that extend radially outward from the cylindrical shell 96. The projections 100 are similarly sized as the projections 98 to center the expansion chamber inside the sleeve 24. As shown, the expansion chamber 38 includes five projections evenly spaced around the cylindrical shell 96. In other examples, the expansion chamber 38 can include more or less than five projections 100. In still other examples, the projections 100 can include a single rib or annular wall with openings spaced around the cylindrical shell 96 or the projections 100 can have other shapes or profiles.

The base 102 of the expansion chamber 38 is positioned at the second end 106. The base 102 is an annular wall that projects outward from the cylindrical shell 96. The base 102 is sized with an outer diameter that is less than the inner diameter of the sleeve 24 so that the expansion chamber 38 can fit inside the sleeve 24. The base 102 can have an outer diameter that is the same or approximately the same as the outer radial dimension of the projections 98 and/or the projections 100. The base 102 is positioned at the second end 106 of the expansion chamber 38 and forms an end of the core assembly 26 that is opposite to the centering ring 30. In other examples, the base 102 can have other configurations or other features to interact with adjacent elements of the firearm suppressor 20.

The expansion chamber 38, in this example, includes a cylindrical cavity 108 that is defined by an inner surface of the cylindrical shell 96. The cavity 108 extends through the expansion chamber 38 from the first end 104 to the second send 106. The cavity 108 is sized with a diameter that is larger than the outer diameter of the barrel of the firearm to which the firearm suppressor 20 is attached. This sizing permits the expansion chamber 38 to be received over the barrel of the firearm. To this end, the cavity 108 is aligned with the center axis 40 when the expansion chamber 38 is connected to the body 36.

At the first end 104 of the expansion chamber 38, the inner surface of the cylindrical shell 96 includes, in this example, a threaded portion 110 that extends axially inward from the first end 104. The threaded portion 110 is configured to engage the attachment surface 82 of the body 36. The threaded portion 110 permits the expansion chamber 38 to be threaded, and secured, to the attachment surface 82 of the body 36. As can be appreciated, the expansion chamber 38 can also be easily removed from the body 36. When secured to the body 36, the first end 104 of the expansion chamber 38 is positioned adjacent to the second shoulder 78 of the body 36.

Referring back to FIG. 2, the firearm suppressor 20 includes the end cap 28 positioned adjacent to the core assembly 26 at the entry end 42 of the sleeve 24. The end cap 28 secures the core assembly 26 inside the sleeve 24. To this end, the end cap 28 includes the complimentary threaded portion 54 previously described that connects to the threaded portion 52 positioned on the entry end 42 of the sleeve 24. The complimentary threaded portion 54 permits the end cap 28 to be secured to (or removed from) the sleeve 24. As the end cap 28 is tightened into the sleeve 24, the end cap 28 moves axially inwardly and contacts the base 102 of the expansion chamber 38 to retain the core assembly 26 inside the sleeve 24.

Example core assemblies 26*a*, 26*b* are shown in FIGS. 13 and 14. The examples show the core assemblies 26*a* and 26*b* as they would appear before the core assemblies 26*a* or 26*b* are inserted into the sleeve 24. The differences between the core assemblies 26*a* and 26*b* include the angles of the baffles 34*a* and 34*b* as well as the angles of the centering rings 30*a* and 30*b* and the angles of the vents 64*a* and 64*b*. As can be seen, the oblique angle of the vents 64*a*, the baffles 34*a* and the centering ring 30*a* relative to the center axis 40 is greater than the oblique angle of the vents 64*b*, baffles 34*b* and the centering ring 30*b*. In the examples shown, the oblique angle of the vents 64*a*, the baffles 34*a* and the centering ring 30*a* relative to the center axis 40 is 65 degrees and the oblique angle of the vents 64*b*, the baffles 34*b* and the centering ring 30*b* relative to the center axis 40 is 45 degrees. In other examples, the oblique angle of the vents 64, the baffles 34 and the centering ring 30 relative to the center axis 40 can have other values but is preferably in the range of 30 to 65 degrees.

The example core assembly 26*a* shown in FIG. 13 is described herein but it can be appreciated that the relative position and structure of the core assembly 26*b* is similarly positioned and structured. As shown in FIG. 13, the baffles 34*a* are positioned over the outer surface 70 of the body 36. A first baffle 34*a* is positioned such that it is located adjacent to the first shoulder 76. As previously described, the first shoulder 76 projects radially outward from the outer surface 70 of the body 36 such that the baffle 34*a* is restricted from moving axially toward the muzzle end 66 of the body 36 when the baffle 34 is positioned adjacent to the first shoulder 76. The spacer 32 is positioned adjacent to the baffle 34*a*. Another baffle 34*a* is positioned adjacent to the spacer 32 and this alternating pattern of baffle 34*a* and spacer 32 is continued along the axial length of the body 36. The centering ring 30 is the installed over the distal end 68 at the tapered portion 72 of the body 36. In this manner, the series of baffles 34*a* and the series of spacers 32 are secured in position on the body 36 as shown.

In the alternating pattern previously described, the baffles 34*a* are spaced apart from one another by the spacers 32 such that the baffles 34*a* are positioned between the vents 64*a*. This positioning of the baffles 34*a* relative to the vents 64*a* defines annular angled chambers that surround the body 36. The propellant gases that are ejected when a projectile is fired from the firearm exit the body 36 through the vents 64*a* and enter the annular angled chambers defined by the baffles 34*a*, the body 36 and the spacers 32 (or the sleeve 24). The propellant gases can expand and cool in the annular angled chambers in order to reduce the sound and/or heat that would otherwise occur if the firearm were not fitted with the firearm suppressor 20.

The example core assemblies 26*a* and 26*b* include nine such annular angled chambers. The chambers are defined by the series of nine baffles 34*a*, 34*b* and nine spacers 32. In other examples, the core assembly 26 can include more or less than nine annular angled chambers and subsequently include more or less than nine baffles 34 or nine spacers 32.

FIG. 15 shows the example firearm suppressor 20 attached to a barrel 112 of a firearm 114. As can be seen, the core assembly 26 is positioned inside the sleeve 24 between the locator cap 22 and the end cap 28. The barrel 112 is attached to the firearm suppressor 20 at the muzzle end 66 of the body 36. The expansion chamber 38 extends over (and around) the barrel 112 from the muzzle end 66 of the body 36. In this arrangement, the firearm suppressor is in the over-barrel configuration since a portion of the firearm suppressor 20 (namely, the expansion chamber 38) is positioned to surround a portion of the barrel 112.

In the over-barrel configuration shown in FIG. 15, the sleeve 24 is of sufficient length to extend over the body 36 and over the expansion chamber 38. As can be seen, one or more of the vents 64 are positioned between the first shoulder 76 and the muzzle end 66 of the body 36. Since two of the vents 64 are positioned in this manner in this example, the baffles 34 do not separate these vents 64 into the previously described annular angled chambers. Instead, these vents 64 are in fluid communication with a cavity 116 that is defined by the body 36, the sleeve 24 and the expansion chamber 38. As can be appreciated, projectile gases expelled by the firearm 114 into the firearm suppressor 20 can travel through the vents 64 located in fluid communication with the cavity 116. The cavity 116 permits further expansion, slowing and cooling of the projectile gases to occur in addition to the slowing and cooling that occurs in the previously described annular angled chambers.

As shown in FIG. 16, the firearm suppressor 20 can also be operated in a muzzle-forward configuration. In the muzzle-forward configuration, the expansion chamber 38 has been removed from the firearm suppressor 20 and a second sleeve 24*a* has been installed over the core assembly 26 without the expansion chamber 38. As shown, the firearm suppressor 20 is secured to a barrel 118 of a firearm 120. In the muzzle-forward configuration, the firearm suppressor 20 is positioned in front of the barrel 118 and does not surround the barrel 118 since the expansion chamber 38 has been removed from the core assembly 26.

The firearm suppressor 20 is a versatile, modular suppressor that can be easily converted from the over-barrel configuration to the muzzle-forward configuration. The modular nature of the firearm suppressor 20 also permits a user to easily assembly or disassemble the firearm suppressor 20 for transport, cleaning or other maintenance.

The firearm suppressor 20 is versatile in that it can be used with a variety of firearms as well. As shown in FIGS. 17A and 17B, the firearm suppressor 20 is assembled in the over-barrel configuration. The firearm suppressor 20 is connected to the firearm 114. The firearm 114, in this example, is a rifle with an elongated barrel 112. This configuration of the firearm 114 permits the firearm suppressor to be used in the over-barrel configuration.

As shown in FIGS. 18A and 18B, the firearm suppressor 20 is assembled in the muzzle-forward configuration. The firearm suppressor 20 is connected to the firearm 120 in this example. The firearm 120 includes a stub barrel. As such, the over-barrel configuration cannot be used on this type of firearm since the expansion chamber 38 would interfere with the firearm.

Referring now to FIG. 19, an example method 128 of converting the firearm suppressor 20 from the over-barrel configuration to the muzzle-forward configuration is shown. In the example method, it is contemplated that the firearm suppressor 20 is initially in the over-barrel configuration (as shown, for example, in FIG. 15). At step 130, a user removes the end cap 28 from the firearm suppressor 20. In the example shown, the end cap 28 is removed by unscrewing the end cap 28 from the entry end 42 of the firearm suppressor 20.

At step 132, the user removes the core assembly 26 from the sleeve 24. Since the entry end 42 of the sleeve 24 is open at this stage of the process, the core assembly 26 can slide out of the sleeve 24 by moving the core assembly 26 along the center axis 40.

At step 134, the user removes the expansion chamber 38 from the core assembly 26. The expansion chamber 38 can be removed from the core assembly, in this example, by unscrewing the expansion chamber 38 from the muzzle end 66 of the body 36. Since the centering ring 30 has not been removed from the distal end 68 of the body 36, the baffles 34 and the spacers 32 are retained to the body 36.

At step 136, the user inserts the core assembly 26 without the expansion chamber 38 into a second sleeve 24*a*. The second sleeve 24*a* is similar in most respects to sleeve 24 except that the second sleeve 24*a* has a length that is shorter than the length of the sleeve 24. The second sleeve 24*a* is shorter because the overall length of the firearm suppressor 20 in the muzzle-forward configuration is shorter than the firearm suppressor 20 in the over-barrel configuration because the firearm suppressor 20 in the muzzle-forward configuration does not include the expansion chamber 38. When the user inserts the core assembly 26 into the second sleeve 24*a*, the user aligns the core alignment feature 88 located on the centering ring 30 with the sleeve alignment feature 58 located on the locator cap 22 to align and orient the core assembly 26 in the second sleeve 24*a*.

The example method can optionally include a step in which the user removes the locator cap 22 from the sleeve 24 and connects the locator cap 22 to the second sleeve 24*a*. This step may be taken in examples of the firearm suppressor 20 in which the locator cap 22 is removable from the sleeve 24. In examples of the firearm suppressor 20 in which the locator cap 22 is fixed to the sleeve 24 (e.g., by welding or by other suitable connection method), the second sleeve 24*a* can be supplied with a second locator cap removably or fixedly connected to the second sleeve 24*a*.

At step 138, the end cap 28 is connected to the entry end of the second sleeve 24*a*. At this step, the end cap 28 contacts the core assembly 26 without the expansion chamber 38 as the end cap 28 is secured to the second sleeve 24*a*. In this manner, the core assembly 26 without the expansion chamber 38 is retained in the second sleeve 24*a* between the locator cap 22 and the end cap 28. At this point, the conversion process is complete and the firearm suppressor 20 is in the muzzle-forward configuration as shown in FIG. 16, for example.

As can be appreciated, a similar method can also be used to convert the firearm suppressor 20 from the muzzle-forward configuration back to the over-barrel configuration. In such a method, the foregoing steps are reversed. The expansion chamber 38 is re-attached to the core assembly 26 and the core assembly 26 is inserted back into the sleeve 24 and the end cap 28 is secured to the sleeve 24 to retain the core assembly 26 in the sleeve 24.

In another aspect of the present disclosure, a kit can be provided that enables a user to assemble the firearm suppressor 20 and/or to convert the firearm suppressor 20 from the over-barrel configuration to the muzzle-forward configuration. An example kit includes the locator cap 22, the sleeve 24, the second sleeve 24*a*, the body 36, the centering ring 30, the spacers 32, the baffles 34, the expansion chamber 38 and the end cap 28. The firearm suppressor 20 described above can be assembled using this kit. The firearm suppressor 20 can also be converted between the over-barrel configuration and the muzzle-forward configuration using this kit. In other example kits, the previously described elements can be pre-assembled or the different components can be combined or further separated in accordance with the present disclosure.

In other example kits, the firearm suppressor 20 can be supplied with one or more different bodies 36 and/or different core assemblies 26. Such alternate bodies 36 and/or alternate core assemblies 26 can have different sizes and/or different angles to accommodate different size firearms or different size projectiles. Such alternate bodies 36 or alternate core assemblies 26 can have common outer diameters such that a common sleeve 24, a common locator cap 22 and/or a common end cap 28 can be used. In such examples, an initial core assembly 26 can be removed and replaced with an alternate core assembly 26 to accommodate a firearm with a larger barrel, for example.

The modular nature of the firearm suppressor 20 permits such interchangeability with different size internal components of the firearm suppressor 20. The modular nature of the firearm suppressor 20 also permits a user to convert, clean, repair and/or maintain the firearm suppressor 20 without tools.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A firearm suppressor comprising:

a hollow sleeve including an outer surface extending between an entry end and an exit end of the hollow sleeve;

a locator cap connected at the exit end of the hollow sleeve, the locator cap including a central hole and a first alignment feature;

a cylindrical body defining a longitudinal passage and a plurality of vents, the plurality of vents in fluid communication with the longitudinal passage and oriented at an angle with respect to a central axis of the longitudinal passage, the cylindrical body including a first end configured to removably attach to a barrel of a firearm and a second end positioned opposite to the first end;

a centering ring connected to the cylindrical body at the second end, the centering ring including a second alignment feature that is configured to engage the first alignment feature on the locator cap to align the cylindrical body in the sleeve such that the central longitudinal passage is aligned with the central hole of the locator cap;

a plurality of baffles received over the body and spaced apart from one another by a plurality of spacers, the plurality of baffles positioned between the plurality of vents to define a plurality of chambers between the hollow sleeve and the cylindrical body;

an expansion chamber removably connected to the first end of the cylindrical body opposite to the centering ring, the expansion chamber extending away from the first end of the cylindrical body such that when the cylindrical body is attached to the barrel of the firearm, the expansion chamber surrounds a portion of the barrel; and an end cap removably connected to the entry end of the sleeve, the end cap contacting the expansion chamber to retain the expansion chamber and the cylindrical body in the hollow sleeve;

wherein the firearm suppressor is operable in an over-barrel configuration in which the expansion chamber is positioned around a portion of the barrel of the firearm when the cylindrical body is attached to the firearm; and the firearm suppressor is operable in a muzzle-forward configuration in which the expansion chamber is removed and the hollow sleeve is replaced with a second hollow sleeve such that the firearm suppressor does not surround a portion of the barrel of the firearm.

2. The firearm suppressor of claim 1 wherein the first alignment feature is a rectangular projection that projects into the sleeve and the second alignment feature is a slot configured to receive the rectangular projection.

3. The firearm suppressor of claim 1 wherein:

the cylindrical body includes a threaded portion on an outer diameter at the first end thereof; and the expansion chamber includes a complimentary threaded portion on an inner diameter thereof, the complimentary threaded portion of the expansion chamber configured to engage the threaded portion of the cylindrical body such that the expansion chamber can be removably connected to the first end of the cylindrical body.

4. The firearm suppressor of claim 1 wherein the locator cap is welded to the exit end of the hollow sleeve.

5. The firearm suppressor of claim 1 wherein:

the cylindrical body includes a baffle shoulder, the baffle shoulder projecting radially away from an outer diameter of the cylindrical body around the outer diameter; and the plurality of baffles are retained to the cylindrical body between the centering ring and the baffle shoulder.

6. The firearm suppressor of claim 1 wherein the outer surface of the hollow sleeve has a helical splined exterior surface profile along at least a portion thereof.

7. The firearm suppressor of claim 1 wherein the cylindrical body, the centering ring, the plurality of baffles and the end cap are configured for use with a second hollow sleeve having a second length that is shorter than a first length of the hollow sleeve, the centering ring, the cylindrical body and the plurality of baffles retained inside the second hollow sleeve by the end cap without the expansion chamber.

8. The firearm suppressor of claim 1 wherein:

the end cap includes a threaded portion on an outer diameter thereof; and the hollow sleeve includes a complimentary threaded portion on an inner diameter at the entry end thereof, the complimentary threaded portion of the hollow sleeve configured to engage the threaded portion of the end cap such that the end cap can be removably connected to the entry end of the hollow sleeve.

9. The firearm suppressor of claim 1 wherein the expansion chamber includes an exterior cylindrical surface having an outer diameter, the outer diameter of the expansion chamber is less than an inner diameter of the hollow sleeve such that the exterior cylindrical surface of the expansion chamber is separated from the hollow sleeve to define a void, the void in fluid communication with at least one of the plurality of vents.

10. A kit for assembling a firearm suppressor that is operable in an over-barrel configuration and in a muzzle-forward configuration, the kit comprising:

a first hollow sleeve having a first length and including an outer surface extending between an entry end and an exit end of the first sleeve;

a second hollow sleeve having a second length that is less than the first length, the second hollow sleeve extending between an entry end and an exit end of the second sleeve;

a cylindrical body defining a central longitudinal passage and a plurality of vents, the plurality of vents in fluid communication with the longitudinal passage and oriented at an angle with respect to a central axis of the central longitudinal passage, the cylindrical body including a first end configured to removably attach to a barrel of a firearm and a second end positioned opposite to the first end;

a centering ring configured to connect to the cylindrical body at the second end, the centering ring further configured to align the cylindrical body in the sleeve such that the central longitudinal passage is centered in the first sleeve or in the second sleeve;

a plurality of baffles configured to be installed over the body and spaced apart from one another by a plurality of spacers, the plurality of baffles positioned between the plurality of vents to define a plurality of chambers between the first sleeve or the second sleeve and the body;

an expansion chamber configured to removably connect to the first end of the cylindrical body opposite to the centering ring, the expansion chamber extending away from the first end of the cylindrical body such that when the cylindrical body is attached to a barrel of a firearm, the expansion chamber surrounds a portion of the barrel when the firearm suppressor is assembled in the over-barrel configuration; and an end cap configured to removably connect to the entry end of the first sleeve or the entry end of the second sleeve, the end cap contacting the expansion chamber to retain the expansion chamber and the cylindrical body in the first sleeve when the firearm suppressor is assembled in the over-barrel configuration, the end cap contacting the cylindrical body to retain the cylindrical body in the second sleeve when the firearm suppressor is assembled in the muzzle-forward configuration.

11. The kit for assembling a firearm suppressor of claim 10 further comprising a locator cap, the locator cap configured to connect to the exit end of the first sleeve or the exit end of the second sleeve, the locator cap including a first alignment feature that engages the centering ring to align the cylindrical body in the first sleeve or in the second sleeve.

12. The kit for assembling a firearm suppressor of claim 10 further comprising the plurality of spacers, the plurality of spacers having outer diameters less than an inner diameter of the first sleeve or an inner diameter of the second sleeve such that the plurality of spacers nests inside the first sleeve or second sleeve to define the plurality of chambers.

13. The kit for assembling a firearm suppressor of claim 10 wherein:

the cylindrical body includes a threaded portion on an outer diameter at the first end thereof; and the expansion chamber includes a complimentary threaded portion on an inner diameter thereof, the complimentary threaded portion of the expansion chamber configured to engage the threaded portion of the cylindrical body such that the expansion chamber can be removably connected to the first end of the cylindrical body.

14. The kit for assembling a firearm suppressor of claim 10 wherein the outer surface of the first hollow sleeve has a helical splined exterior surface profile along at least a portion thereof.

15. A method for converting a firearm suppressor from an over-barrel configuration to a muzzle-forward configuration, the method comprising:

removing an end cap from a first sleeve of the firearm suppressor, the end cap including a threaded portion configured to removably connect the end cap to an entry end of the first sleeve;

removing a core assembly from the first sleeve, the core assembly comprising:

a cylindrical body defining a central longitudinal passage and a plurality of vents, the plurality of vents in fluid communication with the longitudinal passage and oriented at an angle with respect to a central axis of the central longitudinal passage, the cylindrical body including a first end configured to removably attach to a barrel of a firearm and a second end positioned opposite to the first end;

a centering ring connected to the cylindrical body at the second end, the centering ring including a core alignment feature that is configured to engage a sleeve alignment feature to align the cylindrical body in the first sleeve such that the central longitudinal passage is centered inside the first sleeve;

a plurality of baffles received over the cylindrical body and spaced apart from one another by a plurality of spacers, the plurality of baffles positioned between the plurality of vents to define a plurality of chambers; and an expansion chamber removably connected to the first end of the cylindrical body opposite to the centering ring, the expansion chamber extending away from the first end of the cylindrical body such that when the cylindrical body is attached to the barrel of the firearm, the expansion chamber surrounds a portion of the barrel;

removing the expansion chamber from the core assembly;

inserting the core assembly without the expansion chamber into a second sleeve, the second sleeve having a length that is shorter than a length of the first sleeve;

connecting the end cap to the second sleeve to retain the core assembly without the expansion chamber inside the second sleeve.

16. The method of claim 15 wherein the step of inserting the core assembly without the expansion chamber into the second sleeve includes aligning the core alignment feature on the centering with the sleeve alignment feature located on a locator cap that is connected to an end of the second sleeve.

17. The method of claim 15 further comprising:

removing a locator cap from the first sleeve, the locator cap configured to removably attach to the first sleeve or the second sleeve, the locator cap including the sleeve alignment feature; and connecting the locator cap to the second sleeve.

18. The method of claim 16 wherein the step of removing the expansion chamber from the core assembly includes disengaging a threaded portion on an inner surface of the expansion chamber from a complimentary threaded portion on an outer surface of the cylindrical body.

19. The method of claim 16 wherein the step of removing the core assembly from the first sleeve includes sliding the core assembly in an axial direction from inside the first sleeve.

* * * * *